United States Patent [19]

Huber

[11] Patent Number: 4,640,677

[45] Date of Patent: Feb. 3, 1987

[54] GAS CONTROL DEVICE FOR CONTROLLING THE FUEL GAS AND OXIDIZING AGENT SUPPLY TO A BURNER IN AN ATOMIC ABSORPTION SPECTROMETER

[75] Inventor: Bernhard Huber, Uberlingen, Fed. Rep. of Germany

[73] Assignee: Bodenseewerk Perkin-Elmer & Co., GmbH, Uberlingen, Fed. Rep. of Germany

[21] Appl. No.: 704,830

[22] Filed: Feb. 25, 1985

[30] Foreign Application Priority Data

Mar. 1, 1984 [DE] Fed. Rep. of Germany ..... 3407552

[51] Int. Cl.[4] ..... F23N 1/02

[52] U.S. Cl. ..... 431/89; 431/12; 431/281; 251/129.12; 137/112; 137/505.41

[58] Field of Search ..... 431/12, 89, 90, 281; 236/15 BD; 137/112, 114, 505.41; 251/129.12, 129.13

[56] References Cited

U.S. PATENT DOCUMENTS

| | | | |
|---|---|---|---|
| 1,325,116 | 12/1919 | Sebille | 431/12 |
| 2,170,136 | 8/1939 | Gavin | 137/114 |
| 2,416,161 | 2/1947 | Deck | 431/12 X |
| 3,010,468 | 11/1961 | Acomb | 137/114 |
| 3,583,844 | 6/1971 | Smith | 356/315 X |
| 3,653,394 | 4/1972 | McJones | 137/114 |
| 3,712,582 | 1/1973 | Moesta | 257/129.12 |
| 3,762,428 | 10/1973 | Beck et al. | 137/101.19 X |
| 3,856,042 | 12/1974 | Fletcher et al. | 137/505.38 X |
| 4,099,704 | 7/1978 | Okumura et al. | 251/129.12 |
| 4,111,637 | 9/1978 | Hillman | 431/90 X |
| 4,125,225 | 11/1978 | Venghiattis | 239/346 X |
| 4,220,413 | 9/1980 | Targowski et al. | 431/126 X |
| 4,250,553 | 2/1981 | Sebems et al. | 364/510 |
| 4,277,254 | 7/1981 | Hanson | 137/101.19 |
| 4,348,169 | 9/1982 | Swithenbank et al. | 431/89 |
| 4,490,156 | 12/1984 | Marion et al. | 431/90 |

FOREIGN PATENT DOCUMENTS

| | | | |
|---|---|---|---|
| 24140 | 3/1978 | Japan | 431/90 |
| 131621 | 10/1980 | Japan | 431/89 |
| 65518 | 4/1982 | Japan | 431/90 |
| 1474024 | 5/1977 | United Kingdom . | |
| 2113831 | 8/1983 | United Kingdom . | |

*Primary Examiner*—Samuel Scott
*Assistant Examiner*—Carl D. Price
*Attorney, Agent, or Firm*—Edwin T. Grimes; Francis L. Masselle; Thomas P. Murphy

[57] ABSTRACT

The present invention is directed to a gas control device for controlling the fuel gas and the oxidizing agent supplied to a burner in an atomic absorption spectrometer, which includes a first restrictor and a first pressure regulator for the fuel gas line, and a second restrictor and a second pressure regulator of the oxidizing agent line, the regulators being connected upstream of the restrictors, respectively, and servomotors for reproducibly adjusting the pressure settings of the pressure regulators, respectively.

6 Claims, 7 Drawing Figures

GAS CONTROL DEVICE FOR CONTROLLING THE FUEL GAS AND OXIDIZING AGENT SUPPLY TO A BURNER IN AN ATOMIC ABSORPTION SPECTROMETER

FIELD OF INVENTION

The invention relates to a gas control device for controlling the fuel gas and oxidizing agent supply to a burner in an atomic absorption spectrometer, which includes a first restrictor for the fuel gas line and a second restrictor for the oxidizing agent line, and a first pressure regulator for the fuel gas line and a second pressure regulator for the oxidizing agent line, said regulators being connected upstream of the restrictors, respectively.

BACKGROUND OF THE INVENTION

In an atomic absorption spectrometer, a line emitting light source emits a light beam, which comprises the resonant spectral lines of an element being looked for. This light beam passes through a flame from a burner and impinges upon a photoelectric detector. The liquid sample, which is to be analyzed, is sprayed into the flame by means of an atomizer, so that the sample is atomized by the flame and the elements present in the sample are present in their atomic state in the flame. The attenuation of the light beam in the flame is indicative of the proportion of the element being looked for in the sample. The burner is operated with a fuel gas, such as for example acetylene, and air as the oxidizing agent. It is also known in the prior art to supply nitrous oxide gas ($N_2O$) as the oxidizing agent, instead of air, to the burner in order to obtain a hotter flame. Nitrous oxide has a higher proportion of oxygen than air, and when it is used, the supply of fuel gas is increased in order to provide the correct stoichiometric ratio of fuel gas and oxidizing agent.

In order to obtain reproducible conditions, a gas control device is provided, which ensures the adjustment of the gas flows to the burner, as well as the stabilization thereof.

In prior art gas control devices, needle valves were provided for the adjustment of the gas flows. The gas flows were indicated by means of a flow meter and adjusted by manual adjustment of the needle valves. In order to ensure maintenance of the gas flows once adjusted, a pressure regulator (or pressure reducer) was located upstream of each needle valve. These pressure regulators maintained constant pressure upstream of the needle valves, respectively. Thus, the gas flows were adjusted and regulated by means of adjustable restrictors at a constant inlet pressure.

Usually, the flame was first ignited with air as the oxidizing agent. The changing-over to nitrous oxide gas, if required, did not take place until after the flame was ignited. The increase in the fuel gas flow required, when operating with nitrous oxide was obtained by opening a by-pass to the needle valve.

In the prior art gas control devices, the gas flows were adjusted by hand at the needle valves. Therefore, the gas control devices had to be arranged so that the needle valves were easily accessible. This required, in many cases, relatively long conduit connections within the device.

SUMMARY OF THE INVENTION

It is an object of the present invention to provide a gas control device of the above defined type, which has as simple a means as possible for adjustment by control signals from an operating unit or a control unit.

According to the invention, this and other objects are achieved by the provision of a new and improved gas control device which includes, in combination, a first restrictor and a first pressure regulator for the fuel gas line, and a second restrictor and a second pressure regulator for the oxidizing agent line, the regulators being connected upstream of the restrictors, respectively, and servomotors for reproducibly adjusting the pressure settings of the pressure regulators, respectively.

As a result, for adjusting the flow, the flow cross sectional area is not varied with constant pressure, but the pressure is varied with a fixed restrictor. As a consequence, no expensive needle valves are required. The use of a servomotor for the adjustment of the pressure regulator to a desired value permits adjustment by control signals. Consequently, it is not necessary to make the restrictors easily accessible, as was the case with the prior art needle valves, which were adjustable by hand. The pressure can be easily and reproducibly adjusted as desired, and each such pressure can be associated unambiguously with a certain flow. Therefore, no additional flowmeters are required. The flow of the fuel gas can be increased in a well-defined manner by the servomotor, and the desired value of the pressure regulator is readily obtainable, when changing-over to a second oxidizing agent having a higher proportion of oxygen, such as nitrous oxide for example. A by-pass around the restrictor and control means therefore, as was required by the prior art, can be omitted.

There has thus been outlined rather broadly the more important features of the invention in order that the detailed description thereof that follows may be better understood, and in order that the present contribution to the art may be better appreciated. There are, of course, additional features of the invention that will be described more fully hereinafter. Those skilled in the art will appreciate that the conception on which this disclosure is based may readily be utilized as the basis of the designing of other apparatus for carrying out the various purposes of the invention. It is important, therefore, that this disclosure be regarded as including such equivalent apparatus as do not depart from the spirit and scope of the invention.

One embodiment of the invention has been chosen for purposes of illustration and description, and is shown in the accompanying drawings forming a part of the specification.

DETAILED DESCRIPTION OF A PRESENTLY PREFERRED EMBODIMENT

Figure 1:
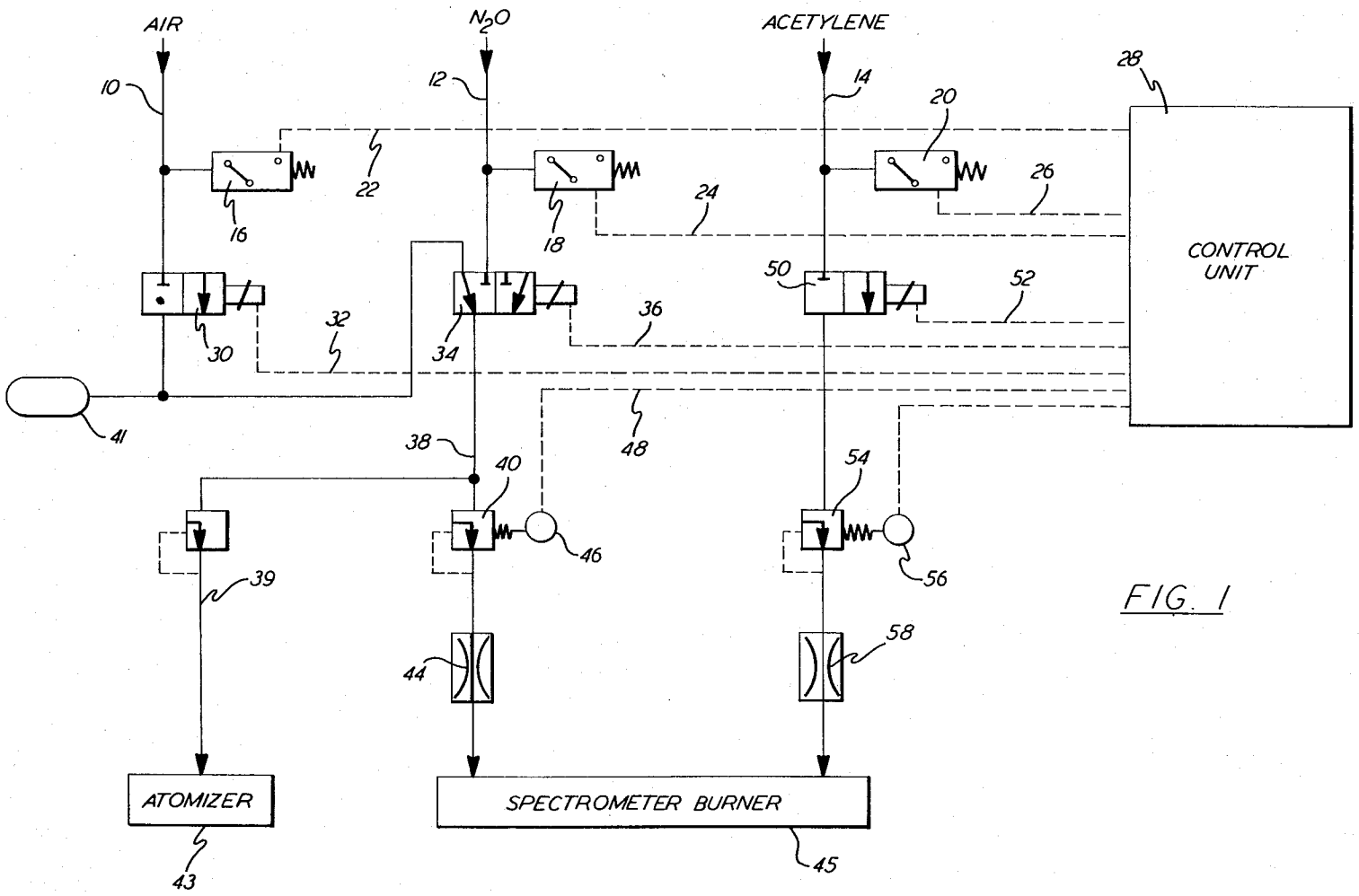
FIG. 1 is a schematic diagram of a gas control device, according to the invention.

Referring to FIG. 1, the gas control device comprises a first port 10, to which air as a first oxidizing agent in the form of compressed air can be connected, and a second port 12, which can be connected to a source of $N_2O$ as a second oxidizing agent. A third port 14 can be connected to a source of fuel gas, preferably acetylene. Pressure sensors 16, 18 and 20 are connected to the ports 10, 12 and 14, respectively. The pressure sensors 16, 18, 20 signal whether or not a gas pressure is being applied to the port in question. These signals are applied to a control unit 28 through signal lines 22, 24 and 26, respectively. The control unit 28 is a microprocessor-controlled electronic system and is programmed in a manner that will be described more fully hereinafter.

A shut-off valve 30, preferably a solenoid valve, is arranged downstream of the first port 10. This valve is controlled by the control unit 28 through a control line 32, which is closed in its deenergized state.

A 3/2-directional control valve 34, preferably a solenoid valve, is controlled by the control unit 28 through a control line 36. In its first position the 3/2-directional control valve 34 connects the first port 10 and the shut-off valve 30, arranged downstream thereof, to a conduit 38, while the second port 12 is closed. In its second position the 3/2-directional control valve 34 connects the second port 12 to the conduit 38, while communication with the shut-off valve 30 and the first port 10 is shut-off. In its deenergized state the 3/2-directional control valve 34 is in its first position, as illustrated in FIG. 1.

Still referring to FIG. 1, a branch conduit 39 extends from the conduit 38 to an atomizer 43. A storage container 41 is connected between the shut-off valve 30 and the 3/2-directional control valve 34.

The conduit 38 is connected to a pressure regulator 40. The outlet of the pressure regulator 40 is connected to an oxidizing agent port of a burner 45 of an atomic absorption spectrometer through a fixed restrictor 44. The pressure regulator 40 is a conventional pressure reducing valve, the desired setting value of which is variably controlled through an actuating spindle, as will be described more fully hereinafter with reference to FIG. 2. The actuating spindle is movable by an appropriate pick-off means or servomotor 46. The servomotor 46 sends position signals to the control unit 28 and is, accordingly, controlled by the control unit. It is connected thereto as indicated by line 48.

A shut-off valve 50, preferably a solenoid valve, is arranged downstream of the third port 14. The shut-off valve is controlled by the control unit 28 through a control line 52. The third port 14 is connected to a pressure regulator 54 through the shut-off valve 50. The pressure regulator 54 is also a conventional pressure reducing valve similar to the pressure regulator 40. A servomotor 56 moves an actuating spindle of the pressure regulator 54 for adjusting it to a desired value. The servomotor 56, or appropriate pick-off means, supplies position signals to the control unit 28. The servomotor 56 is controlled, correspondingly, by the control unit 28. The output of the pressure regulator 54 communicates with a fuel gas port of the burner 45 through a fixed restrictor 58. In one form of the invention the servomotors 46 and 56 are in the form of stepping motors.

Figure 2:
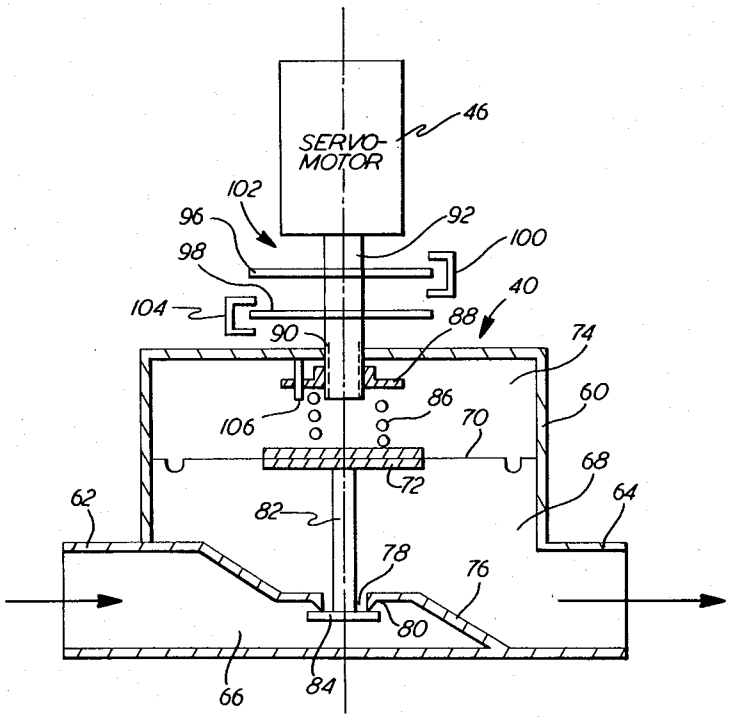
FIG. 2 is an enlarged schematic diagram of a pressure regulator, adjustable by a servomotor in the gas control device according to FIG. 1.

FIG. 2 shows schematically details of the pressure regulator 40. The other pressure regulator 54 is constructed in a similar manner. The pressure regulator 40 comprises a housing 60 having an inlet port 62 and an outlet port 64. The inlet port 62 ends in an inlet chamber 66. The outlet port 64 departs from an outlet chamber 68. A control diaphragm 70 having a diaphragm plate 72 is clamped in the housing 60. The control diaphragm 70 separates the outlet chamber 68 from a diaphragm chamber 74, communicating with the atmosphere. The inlet chamber 66 is separated from the outlet chamber 68 by a partition 76, which forms a valve passage 78 having a valve seat 80 facing the inlet chamber 66. A valve spindle 82 extends through the valve passage 78 and is connected to the diaphragm plate 72. It carries a valve disc 84 at its end within the inlet chamber. The valve disc 84 together with the valve seat 80 forms a control valve. The diaphragm 70 and the diaphragm plate 72 are biased by a compression spring 86. The compression spring 86 is supported at an abutment 88. The abutment 88 is in the form of a nut, which is guided on a thread 90 of an actuating spindle 92. The actuating spindle 92 can be actuated by the servomotor 46. Two discs 96 and 98 are mounted on the actuating spindle 92. One half of the disc 96 is light-transmissive and the other half is opaque. It is scanned by a light detector 100. The disc 96 and the light detector 100 together form a position sensor 102, which responds to position deviations of the actuating spindle 92 from a reference position, and the signals of which are applied to the control unit 28. Preferably, the reference position corresponds to a median position of the actuating spindle 92. The disc 98 is provided with peripherial teeth, which can be scanned by a light detector 104. The light detector 104 forms a sensor, which supplies increment signals when the disc 98 is rotated. The increment signals are applied to the control unit 28. The abutment 88 is guided rectilinearly, as indicated in FIG. 2, by a pin 106 guided in a slot. Thus, the abutment 88 is moved up and down when the actuating spindle 92 is rotated. As a result the bias of the compression spring 86 is varied which, in turn, adjusts the pressure of regulator 40. The control diaphragm 70 and the valve disc 84 are so positioned that the outlet pressure acting on the control diaphragm balances the bias of the compression spring 86.

The control unit 28 is adapted to control the servomotor 46 in accordance with the position deviation signals received from the position sensor 102, whereby the servomotor rotates the actuating spindle 82 to its reference position. Subsequently, the control unit 28 rotates the servomotor 46 from its reference position by an angle, which corresponds to a predetermined number of increment signals. In this way the actuating spindle 92 is adjusted to an exactly defined and reproducible position, and as a result the pressure regulator 40 is adjusted to an exactly defined and reproducible desired value.

FIGS. 3 to 7 illustrate by flow diagrams the mode of operation and the programming of the control unit 28. In these diagrams rectangles having double lateral lines designate subroutines, by means of which particular operations are performed. A rhomb designates a decision or interrogation. The program continues in a horizontal direction to the right or left in the figure upon a "NO" reply and downward upon a "YES" reply. A simple rectangle designates a screen display.

Figure 3:
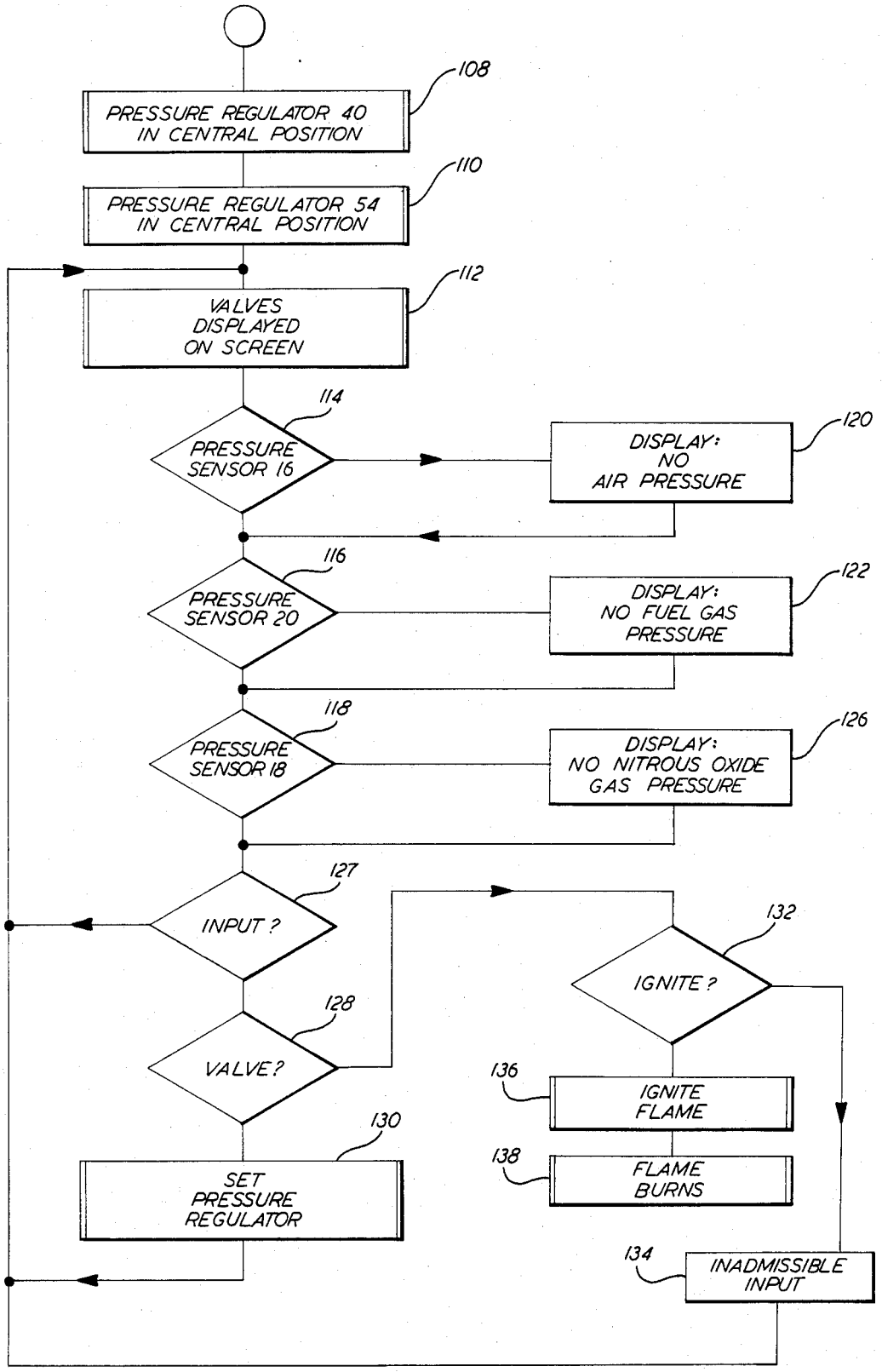
FIG. 3 is a flow-chart, which illustrates the mode of operation of the control unit in the gas control device of FIG. 1.

In FIG. 3, as a first step the two pressure regulators 40 and 54 are moved by means of the subroutines 108 and 110 to their mid-positions, which correspond to the reference position of the actuating spindle 92 and a correspondingly medial, desired outlet pressure. The values obtained of the gas flows from the oxidizing agent and the fuel gas are determined by means of a subroutine 112 and indicated on a screen. Subsequently, the pressure sensors 16, 18, 20 are interrogated, successively. This is illustrated by the rhombs 114, 116 and 118 in FIG. 3. When one of the pressure sensors does not signal a pressure, then it is indicated on its screen. This is illustrated by the rectangles 120, 122 and 126, respectively.

The next interrogation illustrated by the rhomb 127 is whether or not an input takes place. If the reply is "NO", then the steps with the rhombs 114, 116 and 118 are repeated. The gas control device remains in standby state and continuously monitors the gas pressures. If the reply is "YES", then the program passes over to the next interrogation or decision block, which is symbolized by the rhomb 128.

The question is whether the desired values of the pressure regulators are to vary compared with said middle or adjusted value. If the reply is "YES", a subroutine "adjust pressure regulator" is run off, which is represented by the rectangle 130. By this subroutine the desired values of the pressure regulators 40 and 54 are adjusted to predetermined values through the servomotors 46 and 56. After this subroutine has been completed, the steps of the subroutine according to the rectangle 112 and the rhombs 114, 116, 118 and 127 are run once again. If the interrogation represented by the rhomb 128 results in the reply "NO", that is if no further adjustment of the pressure regulators 40 and 54 is required, then the flow diagram continues to the right, as seen in FIG. 3, to the rhomb 132, which symbolizes an interrogation "ignite". A reply "NO" is indicated as "inadmissibly input" (rectangle 134) and leads to the steps hitherto described being repeated once again. The reply "YES" leads to the transition to the subroutines "ignite flame" 136 and "flame burns" 138.

Figure 4:
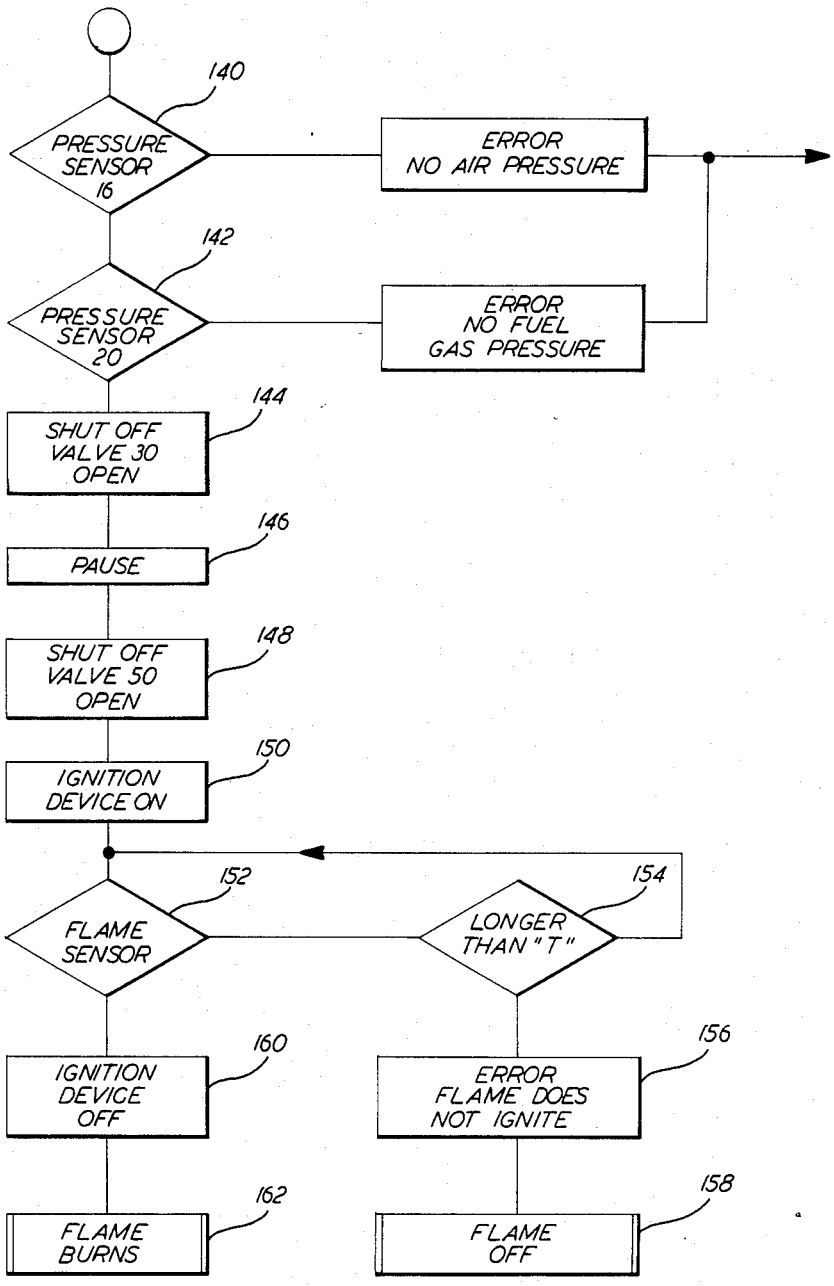
FIG. 4 is a flow-chart of a subroutine "ignite flame" of the flow chart of FIG. 3.

In the subroutine "ignite flame" illustrated in FIG. 4, the pressure sensors 16 and 20 (rhombs 140 and 142) are interrogated again to ensure that an air pressure and a fuel gas pressure exist. For safety reasons the flame of the burner is always ignited first with air and not with nitrous oxide, as the oxidizing agent. Errors are indicated on the screen. Subsequently, the solenoid coil of the shut-off valve 30 is energized through the line 32 and the shut-off valve 30 is opened (rectangle 144). After this operation a pause of, for example, 5 seconds follows (rectangle 146). During this pause the burner is purged with air. After that, the solenoid coil of the shut-off valve 50 is energized (rectangle 148) and as a result the fuel gas starts to flow. Subsequently, an igniter is switched on (rectangle 150). A flame sensor is interrogated (rectangle 152). If the flame sensor indicates that no flame burns, then it is queried whether or not more than a predetermined time T of, for example, 8 seconds has passed since the igniter was switched on (rectangle 154). If this is not the case, then the loop returns to the interrogation of the flame sensors. If no ignition of the flame is signaled after the time T, the flow diagram proceeds from the rhomb 154 downwardly, and "ERROR flame does not ignite" is indicated on the screen (rectangle 156). Then a subroutine "flame off" is run off, which is illustrated by the rectangle 158. As a result, the shut-off valves 50 and 30 are closed consecutively. If the flame is ignited within the predetermined time T, the igniter is switched off (rectangle 160) and the subroutine "flame burns" is executed, which is symbolized by the rectangle 162 and illustrated as a flow diagram in FIG. 5.

Figure 5:
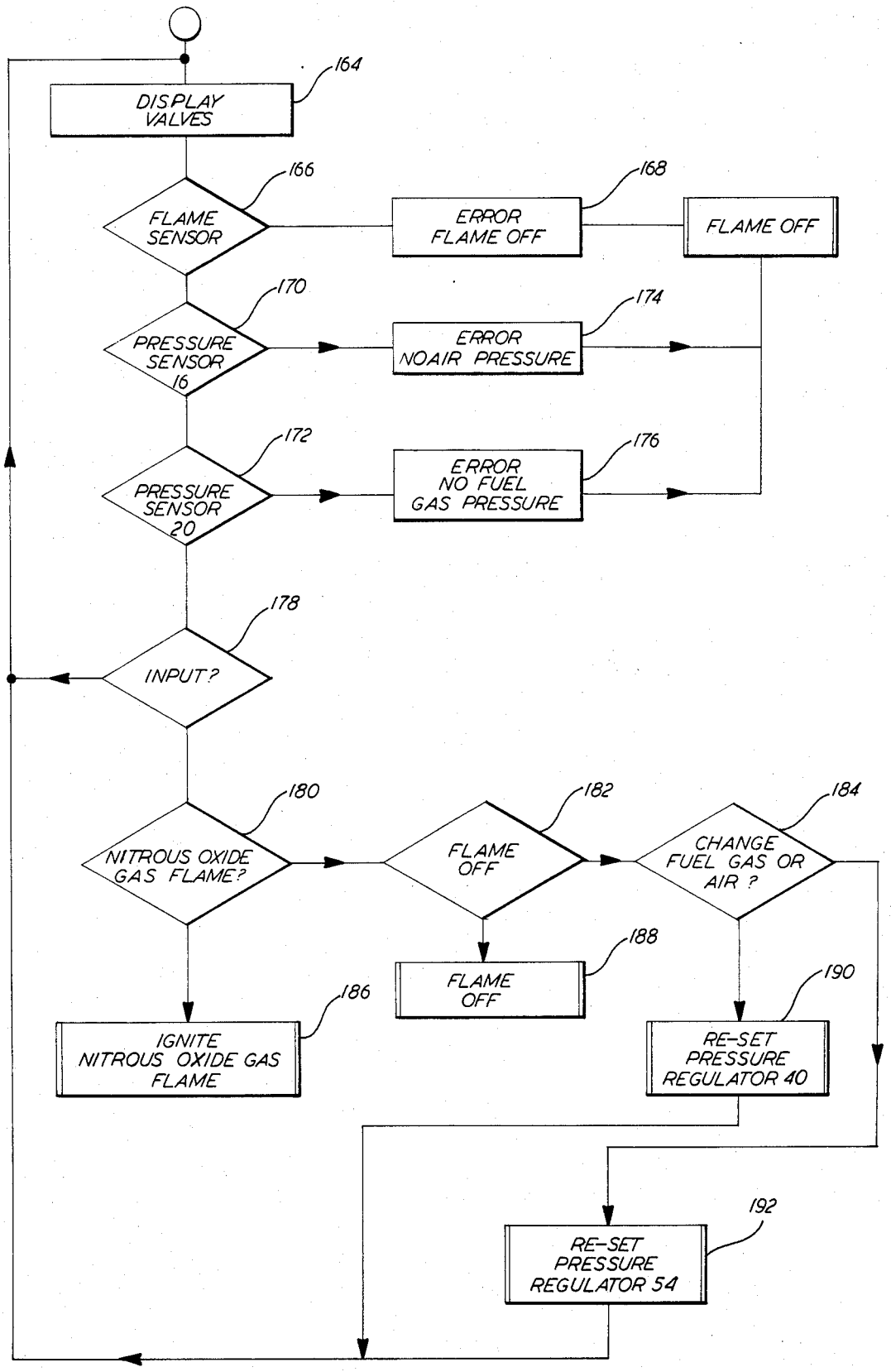
FIG. 5 is a flow chart of a subroutine "flame burns" of the flow chart of FIG. 3.

The subroutine "flame burns", FIG. 5, begins with an indication of the desired values of the pressure regulators or corresponding gas flows (rectangle 164). An interrogation of the flame sensor is indicated by rhomb 166. If the flame sensor does not signal a flame, "ERROR flame off" is indicated (rectangle 168) and said subroutine "flame off" commences. If the flame sensor signals a flame, the pressure sensors 16 and 20 are interrogated again (rhomb 170 and 172) and errors are indicated at the screen (rectangle 174 and 176). Subsequently, it is determined whether or not an input should takes place, that is whether or not any variations should be made (rhomb 178). If the reply is "NO" the subroutine returns to its starting position and runs through the described steps again. Thus, the flame and the gas flows of air and fuel gas are continuously monitored.

When it is determined that an input should be made, then the particular variations are consecutively interrogated as illustrated by rhombs 180, 182 and 183. If the result of an interrogation is "YES", then the flow diagram proceeds downwardly, FIG. 5, to the corresponding subroutine. If the result of the interrogation is "NO", the flow diagram proceeds to the right as seen in FIG. 5 to the next interrogation. In FIG. 5 the first interrogation (rhomb 180) queries whether or not the system should be changed-over to a nitrous oxide gas flame. If this question is answered in the affirmative, then the program passes over to the subroutine "ignite nitrous oxide flame", which is symbolized by the rectangle 186 and illustrated as a flow diagram in FIG. 6. The second interrogation (rhomb 182) queries whether or not the flame should be extinguished. If this question is answered in the affirmative, this leads to the routine "flame off" (rectangle 188) described hereinbefore. The third interrogation (rhomb 184) queries whether or not the fuel gas or air flow should be varied. In the first case the flow diagram passes downwardly as seen in FIG. 5 to a subroutine "vary fuel gas flow" (rectangle 190). In the second case the flow diagram passes to the right, FIG. 5, to the subroutine "vary air flow" (rectangle 192). Then the desired values of the pressure regulators 40 and 54, respectively, are adjusted through the servomotors 46 and 56, as described. After completion of subroutine 190 or subroutine 192, the subroutine "flame burns" returns back to its starting point.

Figure 6:
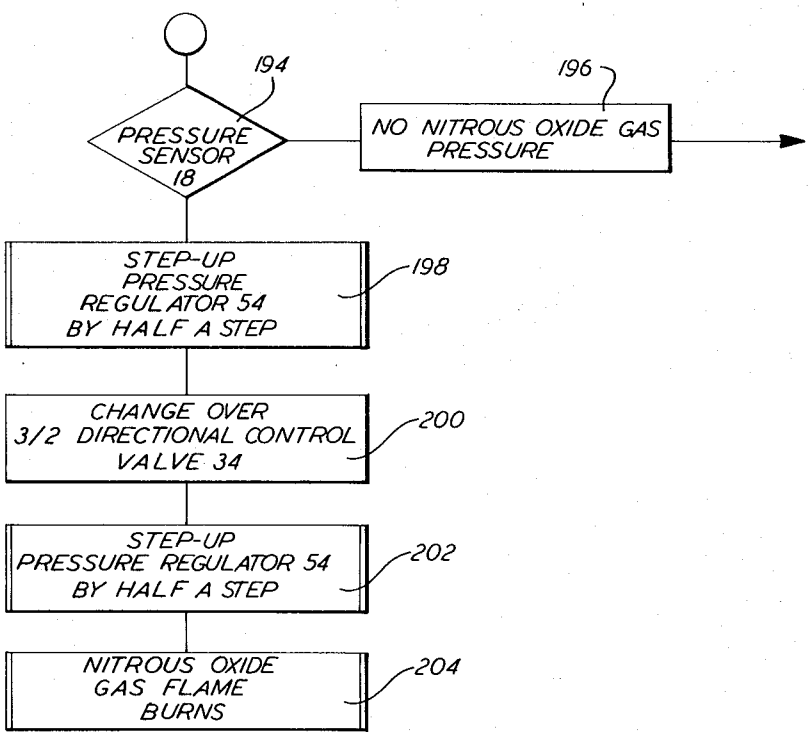
FIG. 6 is a flow chart of a subroutine "ignite nitrous oxide gas flame" of the flow chart of FIG. 5.

The subroutine "ignite nitrous oxide gas" is illustrated as a flow diagram in FIG. 6.

The subroutine begins with an interrogation (rhomb 194) of the pressure sensor 18, i.e. whether or not nitrous oxide gas pressure is present. If there is no nitrous oxide gas pressure, then a screen displays "ERROR no nitrous oxide gas pressure" (rectangle 196). Subsequently, the program returns to the subroutine "flame burns" according to FIG. 5. If nitrous oxide gas pressure is present, the flow diagram passes downwardly to a subroutine, which is symbolized by a rectangle 198. According to this subroutine the pressure regulator 54 for the fuel gas and thus the fuel gas flow is increased by 50 percent. This is the increase necessary when nitrous oxide gas is used. However, because the system is still operating with air as the oxidizing agent, the flame is temporarily too rich. That is, it receives more fuel gas than what corresponds to the stoichiometric ratio of the oxidizing agent being supplied. Then, the solenoid coil of the 3/2-directional control valve 34 is energized through the line 36 and the 3/2-directional control valve 34 is changed over (rectangle 200). As a result, nitrous oxide gas instead of air is supplied as the oxidizing agent to the burner. Now, the flame is too poor. That is, it receives less fuel gas than what corresponds to the stoichiometric ratio required for the oxidizing agent. A subroutine symbolized by a rectangle 202 follows. In this subroutine the pressure setting of the pressure regulator 54 for the fuel gas is increased and thus the fuel gas flow is once again increased by 50 percent. This is the increase in the fuel gas flow needed when nitrous oxide gas is used. Now, the correct stoichiometric ratio of fuel gas to nitrous oxide gas is attained. The infinitely variable increase in the pressure setting of the pressure regulator 54 has the advantage that deviations from the correct stoichiometric ratio of fuel gas to oxidizing agent are always kept as small as possible. Next, the subroutine "nitrous oxide gas burns" follows, which is symbolized by the rectangle 204 in FIG. 6 and is illustrated by the flow diagram in FIG. 7.

Figure 7:
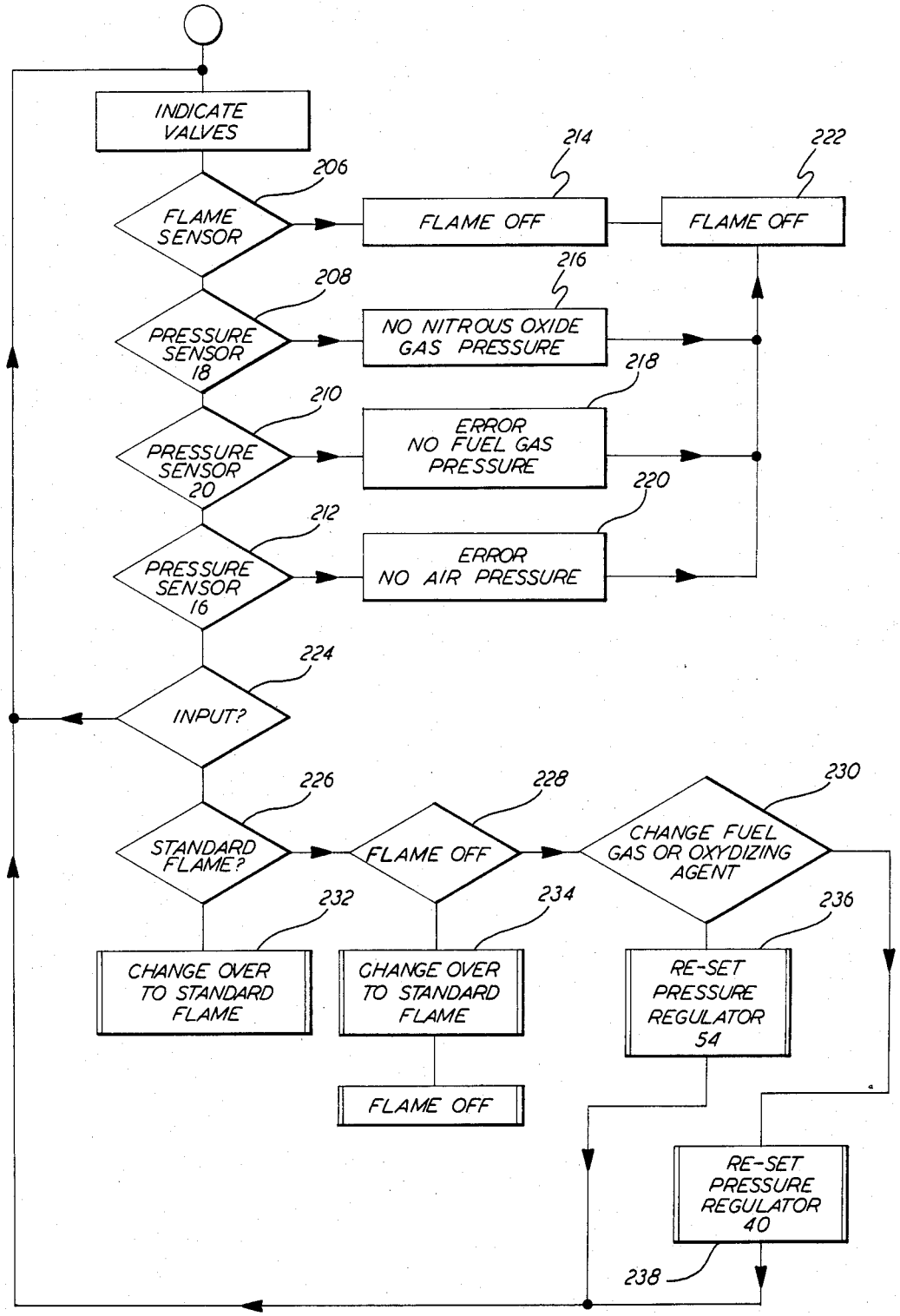
FIG. 7 is a flow chart of a subroutine "nitrous oxide gas flame burns" of the flow chart of FIG. 6.

The subroutine of FIG. 7 is similar to the subroutine of FIG. 5. The flame sensor (rhomb 206) as well as all three pressure sensors 18, 20 and 16 (rhombs 208, 210, 212) are interrogated, and, if required, an error display (rectangles 214, 216, 218, 220) takes place and the flame is switched off (rectangle 222). If no input takes place (rhomb 224), the interrogations are cyclically repeated. If an input takes place, then the flow diagram passes downwardly to a sequential series of interrogating rhomb 226, 228 and 230. Rhomb 226 queries whether or not a change-over to a normal or air fed flame should take place. Rhomb 228 queries whether or not the flame should be switched off, and rhomb 230 queries whether or not the fuel gas or the nitrous oxide gas flow should be varied. If the answer to the query in rhomb 226 is "YES" then the program passes to a subroutine "changeover to normal flame" (rectangle 232). This subroutine corresponds approximately to the subroutine of FIG. 6, except that it is run in inverse succession. That is, the pressure setting of pressure regulator 54 is adjusted downwardly.

If the answer to the query in rhomb 228 is "YES", the burner is changed-over to a normal flame (rectangle 234) and, subsequently, the burner is switched off. The third interrogation (rhomb 230) leads either to a variation of the fuel gas flow or to a variation of the nitrous oxide gas flow (rectangle 236, 238), and in both cases to a following return to start of the subroutine.

By means of additional sensors and interrogation steps, further operating conditions can be controlled, such as, for example, whether or not a burner head is present at all, or whether or not a burner head appropriate for nitrous oxide gas is installed.

In one preferred form of the invention, the servomotors 46, 56 are stepping motors.

If the current should fail or break down, the valves 30, 34 and 50 return to their positions of rest, as illustrated if FIG. 1, whereby the ports 10, 12 and 14 are closed and neither compressed air nor gas can escape. The valves 30, 34 and 50 occupy the same positions of rest when the control unit commands "flame off". The air from the storage container 41 flows through the valve 34, the pressure regulator 40 and the restrictor 44 to the burner and blows out all remains of the fuel gas and the nitrous oxide gas from the burner.

Although a certain particular embodiment of the invention has been herein disclosed for purposes of explanation, various modifications thereof, after study of this specification, will be apparent to those skilled in the art to which the invention pertains.

What is claimed is:

1. A device for controlling fuel gas and oxidizing agent supplied to a burner (45) in an atomic absorption spectrometer, comprising:

a fuel gas line (14) for supplying fuel gas to said burner (45);

an oxidizing agent supply conduit (38) for supplying an oxidizing agent to said burner (45);

a first oxidizing agent supply line (10) for supplying a first oxidizing agent to said oxidizing agent supply conduit (38);

a second oxidizing agent supply line (12) for supplying a second oxidizing agent, having a higher oxygen content than said first oxidizing agent, to said oxidizing agent supply conduit (38);

a control unit (28);

a first restrictor (58) and a first pressure regulator (54) disposed in said fuel gas line; a second restrictor (44) and a second pressure regulator (40) disposed in said oxidizing agent supply conduit (38); the regulators being connected upstream of the restrictors, respectively;

first (56) and second (46) servomotors connected to said first and second pressure regulators, respectively; each of said servomotors being connected to receive signals from said control unit (28) for adjusting the pressure settings of said pressure regulators, respectively;

a 3/2-directional solenoid control value (34) connected between said oxidizing agent supply conduit (38) and said first oxidizing agent supply line (10) in a first valve position, and said 3/2-directional solenoid control valve (34) being connected between said oxidizing agent supply conduit (38) and the second oxidizing agent supply line (12) in a second valve position; said solenoid control valve (34) being connected to receive signals from said control unit (28) for controlling the valve position;

a first shut-off solenoid valve (30) disposed in said first oxidizing agent supply line (10), said first shut-off solenoid valve being connected to receive signals from said control unit (28) for controlling the first shut-off solenoid valve;

a second shut-off solenoid valve (50) disposed in said fuel gas line upstream of said first pressure regulator (54), said second shut-off solenoid valve (50) being connected to receive signals from said control unit (28) for controlling the second shut-off solenoid valve position;

a first pressure sensor (16) disposed in said first oxidizing agent supply line (10) upstream of said first shut-off solenoid valve (30), said first pressure sensor being connected to send signals to said control unit (28) responsive to the pressure in the first oxidizing agent supply line (10);

a second pressure sensor (18) disposed in said second oxidizing agent supply line (12) upstream of said 3/2-directional solenoid control valve (34), said second pressure sensor being connected to send signals to said control unit (28) responsive to the pressure in the second oxidizing agent supply line (12);

a third pressure sensor (20) disposed in said fuel gas line upstream of said second shut-off solenoid valve (50), said third pressure sensor being connected to send signals to said control unit (28) responsive to the pressure in the fuel gas line (14).

2. A device according to claim 1 wherein said control unit (28) includes means for changing-over:

said solenoid shut-off valves (30, 50) to closed positions, respectively, and said 3/2-directional control valve (34) to said first position responsive to the signals from the first, second or third pressure sensors (16, 18, 20), when one of the first, second or third pressure sensors (16, 18, 20) signals a pressure failure.

3. A device according to claim 2 wherein a storage container (41) is connected to the first oxidizing agent supply line (10) downstream of said first shut-off solenoid valve (30).

4. A device according to claim 1 wherein, for changing-over from the first oxidizing agent to the second oxidizing agent, said control unit (28) includes:

means for initially adjusting the setting of the pressure regulator (54) for the fuel gas through the servomotor (56) to a preselected first pressure setting value when the 3/2-directional control valve (34) is in said first position, said first pressure setting value being higher than a preselected value corresponding to the operation with the first oxidizing agent and lower than a second preselected value corresponding to the operation with the second oxidizing agent; and said control unit (28) including means for subsequently changing-over the 3/2-directional control valve (34) from said first position to said second position; and said control unit (28) including means for subsequently adjusting the setting of the pressure regulator (54) for the fuel gas through the servomotor (56) by a second step to said second preselected value corresponding to the operation with the second oxidizing agent.

5. A device according to claim 1 wherein an atomizer (43) is connected to said oxidizing agent supply conduit (38) upstream of said second pressure regulator (40).

6. A device according to claim 1 wherein each of said pressure regulators (40, 54) is a diaphragm type pressure regulator having an actuating spindle (92) for adjusting a pressure setting, servomotors (46, 56) being adapted to rotate said actuating spindle (92) respectively, a disc (98) having peripheral toothing being connected to said actuating spindle (92), a sensor (104) for scanning the toothed edge of the disc (98) and outputting corresponding increment signals to said control unit (28).

* * * * *